US011253876B2

(12) United States Patent
Lo

(10) Patent No.: US 11,253,876 B2
(45) Date of Patent: Feb. 22, 2022

(54) ROTATABLE SPRINKLER

(71) Applicant: YUAN MEI CORP., Chang Hua Hsien (TW)

(72) Inventor: Shun Nan Lo, Chang Hua Hsien (TW)

(73) Assignee: Yuan Mei Corp., Chang Hua Hsien (TW)

( * ) Notice: Subject to any disclaimer, the term of this patent is extended or adjusted under 35 U.S.C. 154(b) by 142 days.

(21) Appl. No.: 16/743,608

(22) Filed: Jan. 15, 2020

(65) Prior Publication Data

US 2021/0213467 A1 Jul. 15, 2021

(51) Int. Cl.

| | |
|---|---|
| ***B05B 3/04*** | (2006.01) |
| ***B05B 1/14*** | (2006.01) |
| ***B05B 15/625*** | (2018.01) |
| ***A63H 23/10*** | (2006.01) |
| ***A63G 31/00*** | (2006.01) |
| ***B05B 1/20*** | (2006.01) |
| ***B05B 15/74*** | (2018.01) |

(52) U.S. Cl.

CPC ..... *B05B 1/205* (2013.01); *B05B 3/0422* (2013.01); *B05B 15/74* (2018.02); *A63G 31/007* (2013.01); *A63H 23/10* (2013.01); *B05B 1/14* (2013.01); *B05B 15/625* (2018.02)

(58) Field of Classification Search

CPC ..... B05B 1/205; B05B 3/04; B05B 3/0409; B05B 3/0418; B05B 3/0422; B05B 3/0427; B05B 15/622; B05B 15/625; B05B 17/00; B05B 17/08; A63H 23/10; A63G 31/007

See application file for complete search history.

(56) References Cited

U.S. PATENT DOCUMENTS 3,878,990 A * 4/1975 Geraudie ..... B05B 3/0472 239/236

8,833,674 B2 * 9/2014 Lo ..... B05B 15/652 239/227

* cited by examiner

*Primary Examiner* — Darren W Gorman

(74) *Attorney, Agent, or Firm* — Muncy, Geissler, Olds & Lowe, P.C.

(57) ABSTRACT

A rotatable sprinkler comprises a base with a continuous curved surface and a rotation element disposed rotatably and relatively to the base. The rotation element has an outlet that connects to a water source. A decorative unit is disposed on a support, part of which is located on the rotation element and the free end of which is in contact with the continuous curved surface of the base. Therefore, the decorative unit may rotate relatively to the base, or move up and down when the free end of the support is pressed against the continuous curved surface.

7 Claims, 3 Drawing Sheets

ROTATABLE SPRINKLER

BACKGROUND OF INVENTION

1. Field of the Invention

The present invention relates generally to a rotatable spray device, and more particularly to a rotatable sprinkler with a decorative function.

2. Description of Related Art

The rotatable sprinkler used in gardening is driven by a plurality of blades, or by a rotating torque generated through the direction of the fluid in the runner pipe, so that the sprinkler rotates to spray the water in all directions to achieve the full spraying. Limited to the rotatable sprinkling area, in larger horticultural landscaping (such as gardens or turf), the nozzles of the sprinkler is installed on branches with multiple water pipes, however, the appearance of water pipe or nozzles usually corresponds directly its functional structural features, so that the nozzles of the sprinkler cannot be integrated into the horticultural landscaping. If the structure of the water pipe or sprinkler is reduced, it may affect the water pressure or the spray area.

SUMMARY OF THE INVENTION

Based on the above-mentioned deficiency, the present invention provides a rotatable sprinkler, which can be additionally installed with a decorative unit to integrate the rotatable sprinkler into the horizontal landscaping.

According to a purpose of the present invention, a rotatable sprinkler has a base and a rotation element capable of rotating relative to a base, wherein the rotation element has an outlet connected with water source, the rotation element is disposed with at least one decorative unit through the support, and a part of the support is positioned at the rotation element, one end of the support is in contact with the bottom surface of the base, and the bottom surface of the base is a continuous curved surface, and at least one low part and at least one high part are defined.

Thereby, the rotation element drives the decorative unit, and the decorative unit also moves against the bottom surface of the base through the support, and moves up and down along the high and low part of the bottom surface to generate the rotation of the decorative unit and the dynamic appearance of the jumping, thereby, the rotation element and the decorative component as a whole can be set with the appearance of the simulated carrousel and integrated into the horizontal landscaping.

Further, the rotation element is disposed in the driving source to rotate relative to the base, and the driving source can be driven by the impeller or the motor. Moreover, the base can be connected with the water source, and the internal space of the rotation element can be connected with the inside of the base, so that the rotation element can rotate against the water flow. In addition, the decorative unit may be located between the rotation element and the base, or, the rotation element may be disposed between the decorative unit and the base, so as to collocate with different modeling configurations. The number of the low part and the high part of the bottom surface corresponding to the number of the decorative unit can change the frequency at which the decorative unit jumps up and down.

DETAILED DESCRIPTION OF THE INVENTION

Figure 1:
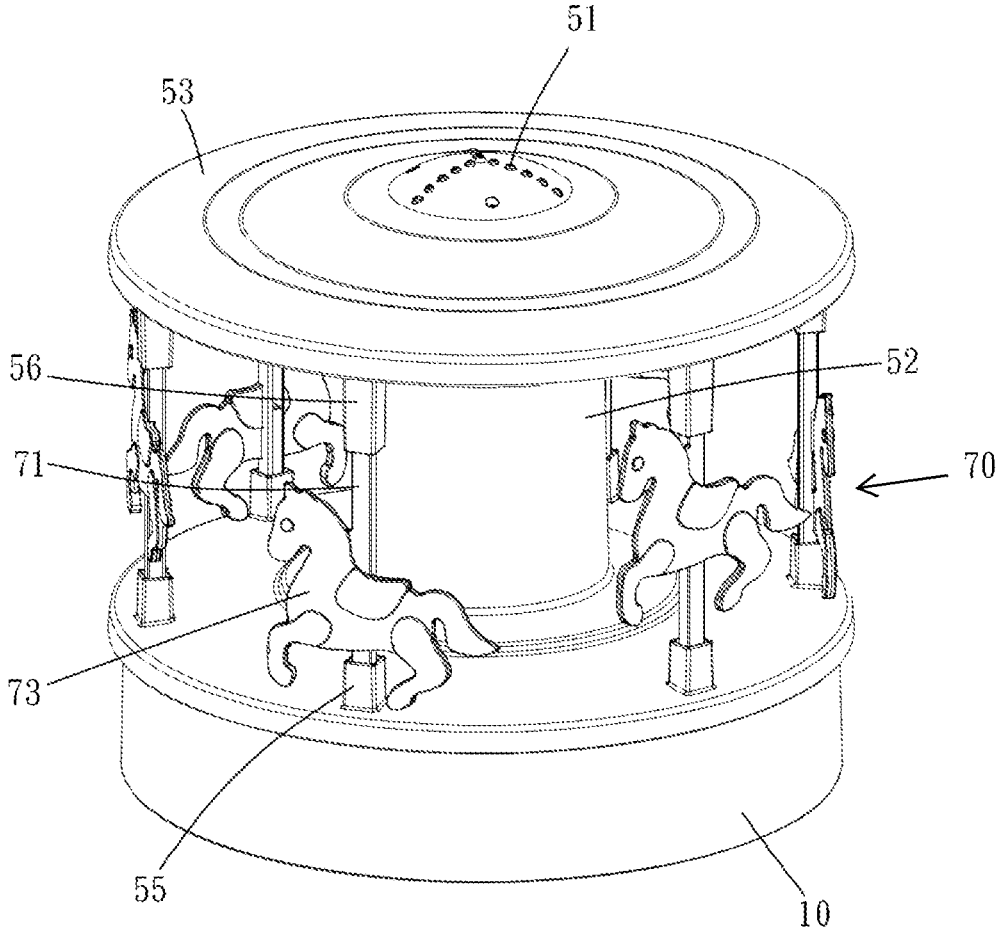
FIG. 1 is an outside view of the rotatable sprinkler.
Figure 2:
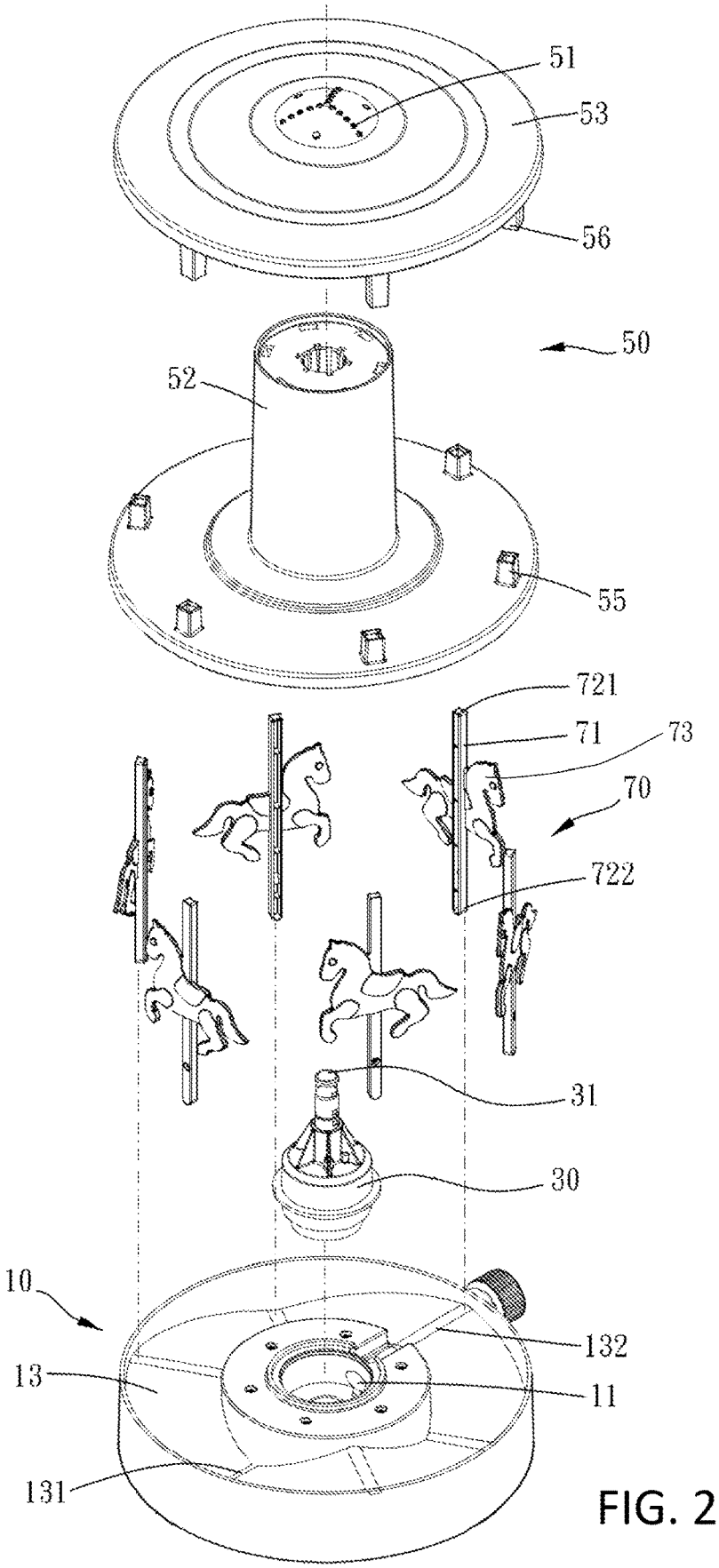
FIG. 2 is an explosion diagram of the rotatable sprinkler.
Figure 3:
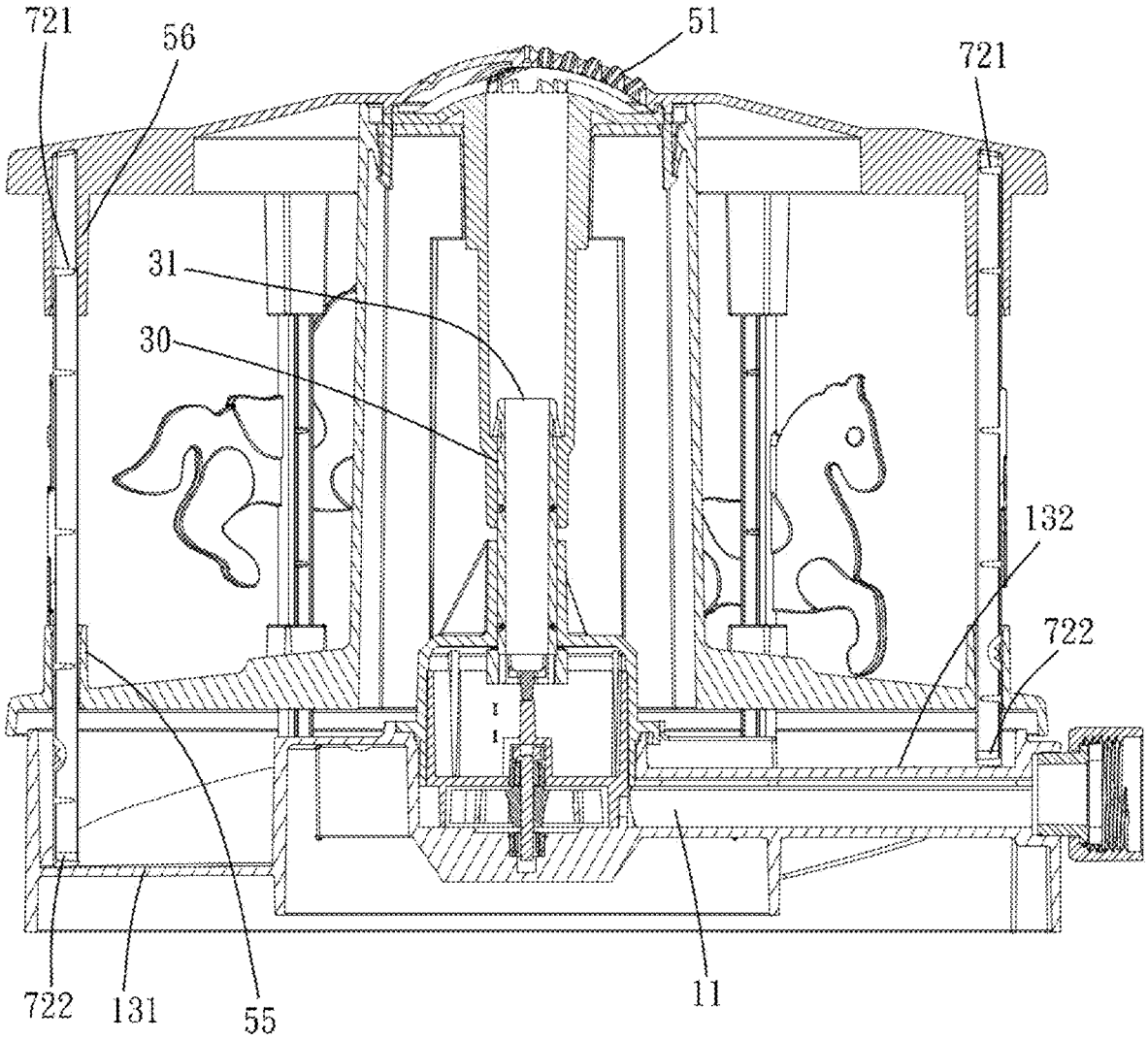
FIG. 3 is a sectional view of the rotatable sprinkler.

Referring to FIGS. 1-3, a rotatable sprinkler mainly comprises a base 10 and a rotation element 50 that rotates relative to the base 10. In this embodiment, the appearance of the carrousel is shown, and different appearance styles can also be designed as needed.

In this embodiment, the rotation element 50 comprises a hollow column 52 and a turntable 53 disposed on the top of the column 52 and away from the base 10. The internal space of the column 52 is connected with the outlet 51 of the turntable 53. The drive part 30 as a driving source is further disposed between the base 10 and the column 52. The drive part 30 is also a hollow column structure, the bottom of which is provided with an impeller disposed coaxially with a hollow column of a drive part 30. When the bottom of the hollow part of the drive part 30 is installed on the base 10, the water flow channel of the base 10 can be connected, and the impeller is adjacent to the water inlet 11 of the base 10. One end of the drive part 30 away from the impeller is used as the water outlet end 31 and is engaged inside the column 52 of the rotation element 50, and the water flow of the base 10 is led into the inner space of the column 52 and discharged from the outlet 51 of the turntable 53.

Thereby, when the water flows through the hollow column of the drive part 30 and the inside of the column 52, the water flow drives the impeller to rotate while driving the turntable 53, so that the rotation element 50 as a whole rotates relative to the base 10. When the water flows out of the outlet 51 of the turntable 53, the rotated rotation element 50 will also spray the water in all directions. However, the driving source may also be such that the rotation element 50 is rotated relative to the base 10 through the motor, and the water source may be directly connected with the inside of the cylinder 52 of the rotation element 50 without passing through the base 10.

Further, the number of outlets 51 may be plural, and they are respectively disposed at any position on the surface of the rotation element 50 and connected with the water source inside the column 52. The outlet 51 may also be provided with a nozzle structure to generate a water flow type such as a high pressure water column or a water mist. The inside of the rotation element 50 may also be provided with a valve to control at least one outlet 51 connected with the water flow in the hollow column 52, so as to change the spraying time interval of the plural outlets 51, while collocating with the music rhythm or sound and light effect.

In this embodiment, the turntable 53 has the appearance of a tent, the decorative unit 70 has a decorative pattern 73 with the appearance of a carrousel, the decorative pattern 73 is installed in the middle section of the support 71, and the support 71 is an elongated shape and has two positioning ends 721 and 722 away from each other. The turntable 53 of the rotation element 50 is outwardly extended and disposed with the positioning groove 56 which corresponds to the number of the support 71 of the decorative unit 70, the opening of the positioning groove 56 is towards the base 10, the bottom of the rotation element 50 is provided with the chassis mounted on the base 10, and the chassis is provided with the guiding groove 55 corresponding to the position of the positioning groove 56. The inside of the guiding groove 55 is a perforation that can be connected with the space between the chassis and base 10. The positioning end 721 of the support 71 is inserted into the positioning groove 56, and the positioning end 722 passes through the guiding groove 55 to be in contact with the bottom surface 13 of the base 10. Therefore, the decorative unit 70 is installed between the rotation element 50 and the base 10 and rotates together with the rotation element 50.

In this embodiment, the bottom surface 13 of the base 10 further comprises a continuous curved surface, and the curved part defines a plurality of low part 131 and a plurality of high part 132, and the low part 131 and the high part 132 are disposed at equal angular intervals by taking the drive part 30 as the axle center, and the number of curved surfaces is equivalent to the number of the decorative unit 70. Further, the depth of the positioning groove 56 is at least greater than the vertical height difference between the low part 131 and the high part 132 on the bottom surface 13. Therefore, the support 71 can move up and down between the end of the positioning groove 56 and the bottom surface 13. When the rotation element 50 is rotating, the plurality of the positioning end 722 of the support 71 will be individually pushed down by the lower part 131 or the high part 132, and will respectively push up the decorative unit 70 on the support 71 to different heights, so that the carrousel is rotated and simultaneously jumped up and down. Therefore, the rotatable sprinkler of the present embodiment is suitable for being placed on the open grassland as a rotatable sprinkler and a decorative unit. In addition, the number of curved surfaces (low part 131 and high part 132) may also be the factor or multiple of the number of the decorative unit 70, the bottom surface of the base 10 13 can also contain the planes, so that a plurality of decorative unit 70 are located at different heights relative to the chassis of the rotation element 50.

In other embodiment, a part of the support can be disposed on the rotation element through other positioning way (e.g., the axle center), the main body of the support has a branch, and the free end of the branch is used as the positioning end (i.e., corresponding to the positioning end 722 in the previous embodiment) in contact with the bottom surface of the base. At this time, the support can also rotate with the rotation element relative to the base, and the continuous curved surface of the base can push against the branch, so that the support swings along the axle center, and also it can generates the dynamic appearance that the decorative unit rotates and jumps up and down.

Further, as long as a part of the support is positioned on the rotation element and a free end of the support is pressed against the bottom surface of the base, so a dynamic appearance that the decorative unit rotates and jumps can be achieved. Therefore, it can also be designed as that the rotation element is located between the decorative unit and the base. In this horizontal landscaping, the position of the base and the rotation element is relatively low, which can highlight the appearance of the decorative unit at a high position.

The invention claimed is:

1. A rotatable sprinkler comprises a base and a rotation element that rotates relative to the base, wherein the rotation element comprises a turntable and at least one outlet disposed on the turntable; and a plurality of decorative units, each of the plurality of decorative units comprises a support and a decorative pattern disposed on the support, the supports of the plurality of decorative units rotate synchronously with the rotation element, a free end of each of the supports is pressed against a bottom surface of the base;

wherein, the bottom surface is a continuous curved surface with at least one low part and at least one high part near the at least one low part;

wherein, the rotation element has a driving source connected to the inside of the base, a water flows through the driving source and flows out of the at least one outlet of the turntable;

wherein the supports of the plurality of decorative units are disposed at the turntable of the rotation element in circumferential direction and in a partition form between the base and the turntable, the decorative patterns are supported by the supports to move up and down relative to the turntable when the rotation element rotates, and the decorative patterns adjacent to each other move in opposite directions.

2. The rotatable sprinkler defined in claim 1, wherein the base is connected to a water source.

3. The rotatable sprinkler defined in claim 1, wherein the at least one outlet is located in the rotation element away from the base.

4. The rotatable sprinkler defined in claim 1, wherein the rotation element comprises a hollow column disposed between the turntable and the base, and the decorative patterns of the plurality of decorative units are located between the turntable and the base and surrounding the hollow column.

5. The rotatable sprinkler defined in claim 1, wherein a part of each of the supports is located in the rotation element.

6. The rotatable sprinkler defined in claim 1, wherein the number of the at least one low part and the at least one high part of the continuous curved surface corresponds to the number of the supports.

7. The rotatable sprinkler defined in claim 1, wherein the number of the at least one outlet of the rotation element is plural.

* * * * *